US011073777B2

(12) United States Patent
Hayamizu

(10) Patent No.: US 11,073,777 B2
(45) Date of Patent: Jul. 27, 2021

(54) IMAGE FORMING APPARATUS WITH AN IMPROVED HEAT PROTECTION FOR THE FUSER DEVICE

(71) Applicant: KYOCERA Document Solutions Inc., Osaka (JP)

(72) Inventor: Hitoshi Hayamizu, Osaka (JP)

(73) Assignee: Kyocera Document Solutions, Inc.

( * ) Notice: Subject to any disclaimer, the term of this patent is extended or adjusted under 35 U.S.C. 154(b) by 0 days.

(21) Appl. No.: 16/621,859

(22) PCT Filed: Sep. 20, 2018

(86) PCT No.: PCT/JP2018/034797
§ 371 (c)(1),
(2) Date: Dec. 12, 2019

(87) PCT Pub. No.: WO2019/065446
PCT Pub. Date: Apr. 4, 2019

(65) Prior Publication Data

US 2021/0088952 A1 Mar. 25, 2021

(30) Foreign Application Priority Data

Sep. 29, 2017 (JP) ..... JP2017-191044

(51) Int. Cl.
*G03G 15/20* (2006.01)

(52) U.S. Cl.
CPC ..... *G03G 15/2053* (2013.01); *G03G 15/2039* (2013.01)

(58) Field of Classification Search
CPC ..... G03G 15/2039; G03G 21/1652
USPC ..... 399/33, 69, 90
See application file for complete search history.

(56) References Cited

U.S. PATENT DOCUMENTS 7,266,314 B2 * 9/2007 Takami ..... G03G 15/2039 399/33
8,744,289 B2 * 6/2014 Shimura ..... G03G 15/2039 399/33
10,379,467 B2 * 8/2019 Muramatsu etal. ..... G03G 15/2039
10,788,775 B2 * 9/2020 Okamoto et al. .. G03G 15/2039

FOREIGN PATENT DOCUMENTS

JP 2004-219468 8/2004

* cited by examiner

*Primary Examiner* — William J Royer

(57) ABSTRACT

A sensor unit (12) includes a thermistor (21) and a connector (22). A protection unit (13) includes a thermal cutoff (31) and a connector (32). First and second intermediate connector units (14-1, 14-2) electrically connects the connectors (22, 32) and an external connection connector (11) to each other, respectively. An intermediate wire (53) electrically connects the first and second intermediate connector units (14-1, 14-2) to each other. The first intermediate connector unit (14-1) electrically connects an end of a loopback wire (23) of the connector (22) to the external connection connector (11), the second intermediate connector unit (14-2) connects an end of the thermal cutoff (31) to the external connection connector (11), the intermediate wire (53) electrically connects an other end of the loopback wire (23) and an other end of the thermal cutoff (31) to each other.

3 Claims, 1 Drawing Sheet

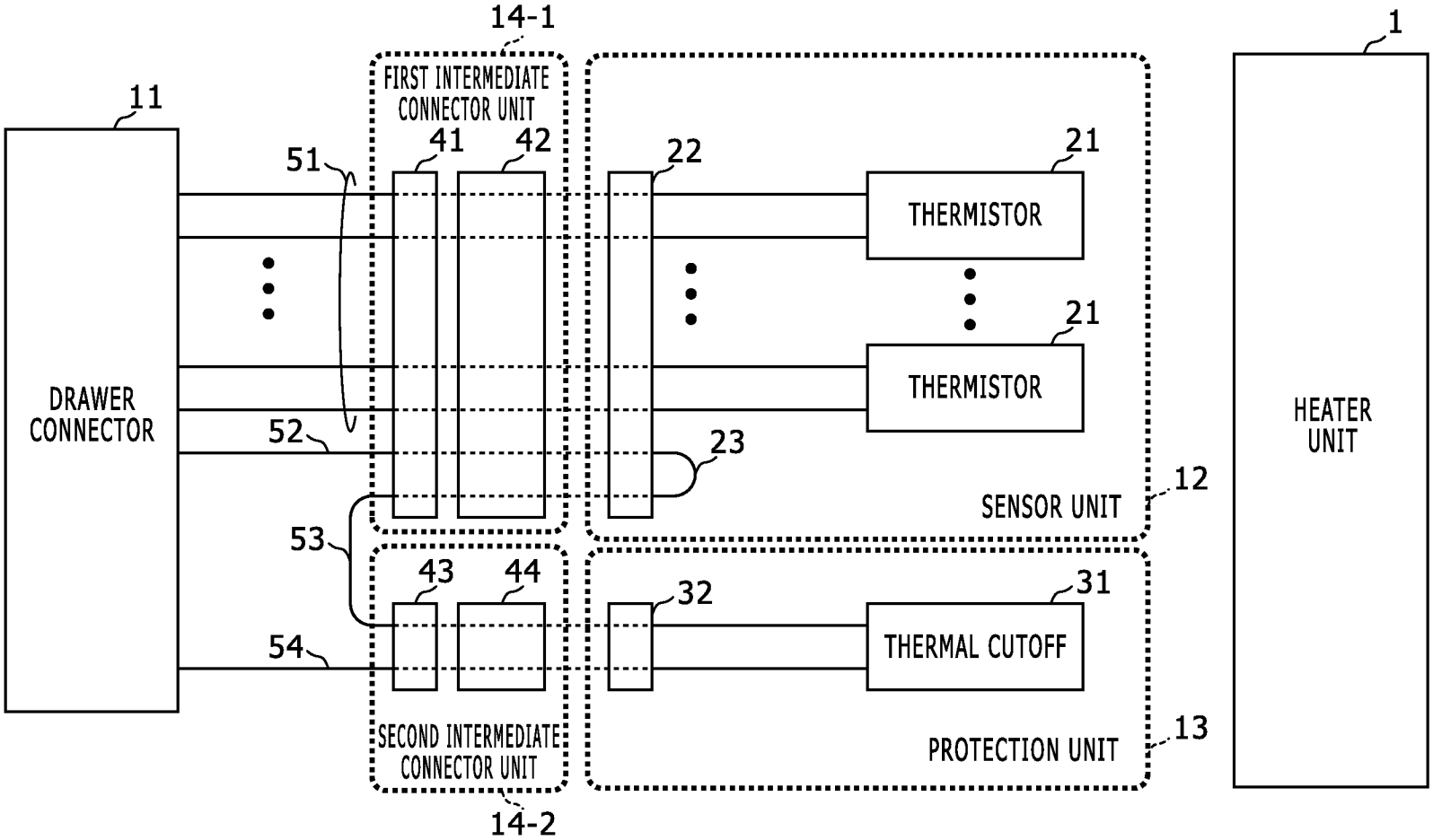
1
HEATER UNIT
12
SENSOR UNIT
13
PROTECTION UNIT
21
THERMISTOR
21
THERMISTOR
31
THERMAL CUTOFF
22
23
32
14-1
FIRST INTERMEDIATE CONNECTOR UNIT
42
41
44
43
SECOND INTERMEDIATE CONNECTOR UNIT
14-2
51
52
53
54
11
DRAWER CONNECTOR

IMAGE FORMING APPARATUS WITH AN IMPROVED HEAT PROTECTION FOR THE FUSER DEVICE

TECHNICAL FIELD

The present invention relates to a fuser device.

BACKGROUND ART

An electrophotographic image forming apparatus such as a multi function peripheral includes a fuser device. The fuser device fixes a toner image on a printing paper sheet by heating and pressurizing the printing paper sheet on which the toner image has been transferred.

In an image forming apparatus, a fuser device includes a heating element, a thermistor to detect a temperature of the heating element, and a thermo switch to protect the image forming apparatus from an abnormal rise in temperature, and is connected with one connector to a control circuit board in a main body of the image forming apparatus (see PATENT LITERATURE #1, for example).

CITATION LIST

Patent Literature

PATENT LITERATURE #1: Japanese Patent Application Publication No. 2004-219468.

SUMMARY OF INVENTION

Technical Problem

In the aforementioned fuser device, the thermistor and the thermo switch are connected to the aforementioned one connector, and thereby form one unit.

Meanwhile, a sensor unit including a thermistor and a protection unit including a thermo switch can be independently manufactured. However, in such cases, connectors (two connectors in total) are installed on the sensor unit and the protection unit, respectively.

For example, in a case that electric power is supplied to the heating element (heater) and a temperature rise is confirmed with the thermistor fora predetermined time (e.g. 40 seconds) when powered on for validation of the sensor unit, if connection failure occurs at the connector of the sensor unit but the protection unit is connected, then a temperature of the heating element (heater) continues to rise and power supply to the heating element (heater) is cut off by the protection unit.

However, if the power supply is repeatedly turned on and off in a short time, electric power is supplied to the heating element (heater) every time that the power supply is turned on, and consequently high temperature status continues and the protection unit repeatedly operates, and therefore the fuser device may go down.

The present invention is conceived in view of the aforementioned problem and aims for providing a fuser device that includes a sensor unit and a protection unit independently of each other and restrains malfunction due to connection failure of the sensor unit.

Solution to Problem

A fuser device according to the present invention includes a heater unit; a sensor unit that comprises a sensor and a first connector, the sensor detecting a temperature at a predetermined position; a protection unit that comprises a thermal cutoff and a second connector, the thermal cutoff cutting off a circuit in accordance with the temperature at the predetermined position; an external connection connector electrically connected to a main body of an image forming apparatus; a first intermediate connector unit that electrically connects the first connector and the external connection connector to each other; a second intermediate connector unit that electrically connects the second connector and the external connection connector to each other; and an intermediate wire that electrically connects the first intermediate connector unit and the second intermediate connector unit to each other. Further, the first connector comprises a loopback wire; the first intermediate connector unit electrically connects an end of the loopback wire to the external connection connector; the second intermediate connector unit electrically connects an end of the thermal cutoff to the external connection connector; and the intermediate wire electrically connects an other end of the loopback wire and an other end of the thermal cutoff.

Advantageous Effect of Invention

By means of the present invention, provided is a fuser device that includes a sensor unit and a protection unit independently of each other and restrains malfunction due to connection failure of the sensor unit.

These and other objects, features and advantages of the present invention will become more apparent upon reading of the following detailed description along with the accompanied drawings.

BRIEF DESCRIPTION OF DRAWINGS

FIG. 1 shows a block diagram that indicates a configuration of a fuser device according to an embodiment of the present invention.

DESCRIPTION OF EMBODIMENTS

Hereinafter, an embodiment according to aspects of the present invention will be explained with reference to a drawing.

FIG. 1 shows a block diagram that indicates a configuration of a fuser device according to an embodiment of the present invention.

The fuser device shown in FIG. 1 is attached into an electrophotographic image forming apparatus (printer, multi function peripheral or the like), and heats and pressurizes a printing paper sheet on which a toner image has been transferred and thereby fixes the toner image on the printing paper sheet.

The fuser device includes a heater unit 1, a drawer connector 11, a sensor unit 12, a protection unit 13, a first intermediate connector unit 14-1, a second intermediate connector unit 14-2, wires 51, 52 and 54, and an intermediate wire 53.

The heater unit 1 generates heat using electric power supplied through the drawer connector 11 and thereby heats a fixing roller. The power supply to the heater unit 1 is controlled in an ON/OFF manner by a controller in a main body of the image forming apparatus. In this embodiment, the heater unit 1 is an IH (Induction Heating) heater.

The drawer connector 11 is fixed in a housing of this fuser device, and is attachable to and detachable from the main body of the image forming apparatus. The drawer connector 11 is an external connection connector electrically connected to the controller in the main body of the image forming apparatus.

The sensor unit 12 is one unit that includes one or plural thermistors 21 and a connector 22. The thermistor 21 is a sensor that detects a temperature at a predetermined position (the heater unit 1, the fixing roller or the like). The connector 22 is attachable to and detachable from the first intermediate connector unit 14-1. The thermistor 21 is electrically connected to the connector 22. Further, the connector 22 includes a loopback wire 23. The loopback wire 23 is a wire that makes a short circuit between two terminals of the connector 22.

The protection unit 13 is a unit that includes a thermal cutoff 31 and a connector 32, as one unit other than the sensor unit 12. The thermal cutoff 31 is a switching element such as a thermostat that cuts off a circuit in accordance with a temperature of a predetermined position (the heater unit 1, the fixing roller or the like). The connector 32 is a connector attachable to and detachable from the second intermediate connector unit 14-2. The thermal cutoff 31 is electrically connected to the connector 32.

The first intermediate connector unit 14-1 electrically connects the connector 22 of the sensor unit 12 and the drawer connector 11 to each other. Further, the first intermediate connector unit 14-1 electrically connects an end of the loopback wire 23 of the sensor unit 12 and the drawer connector 11 to each other.

In this embodiment, the first intermediate connector unit 14-1 includes a connector 41 and an interconnection connector 42. The connector 41 is electrically connected to the drawer connector 11 with wires 51 and 52. The interconnection connector 42 interconnects the connector 41 of the first intermediate connector unit 14-1 and the connector 22 of the sensor unit 12. The wire 51 is a wire electrically connected to the thermistor 21, and the wire 52 is a wire electrically connected to an end of the loopback wire 23 of the sensor unit 12.

The second intermediate connector unit 14-2 electrically connects the connector 32 of the protection unit 13 and the drawer connector 11 to each other. Further, the second intermediate connector unit 14-2 electrically connects an end of the thermal cutoff 31 of the protection unit 13 to the drawer connector 11.

In this embodiment, the second intermediate connector unit 14-2 includes a connector 43 and an interconnection connector 44. The connector 43 is electrically connected to the drawer connector 11 with a wire 54. The interconnection connector 44 interconnects the connector 43 of the second intermediate connector unit 14-2 and the connector 32 of the protection unit 13. The wire 54 is a wire electrically connected to an end of the thermal cutoff 31 of the protection unit 13.

The intermediate wire 53 electrically connects the first intermediate connector unit 14-1 and the second intermediate connector unit 14-2 to each other. In this embodiment, the intermediate wire 53 electrically connects the connector 41 of the first intermediate connector unit 14-1 and the connector 43 of the second intermediate connector unit 14-2 to each other. Further, the intermediate wire 53 electrically connects an other end of the loopback wire 23 of the sensor unit 12 and an other end of the thermal cutoff 31 of the protection unit 13 to each other.

Consequently, through the first intermediate connector unit 14-1, the intermediate wire 53, and the second intermediate connector unit 14-2, the connector 22 (i.e. the loopback wire 23) of the sensor unit 12 is connected to the protection unit 13 (i.e. the thermal cutoff 31) in series.

The following part explains a behavior of the aforementioned fuser device.

(a) Status that the Connections of the Sensor Unit 12 and the Protection Unit 13 are Secured In a status that this fuser device is attached to a main body of an image forming apparatus, the drawer connector 11 is electrically connected to a controller in the main body of the image forming apparatus.

In this status, an output signal of the thermistor 21 is provided to the controller in the main body of the image forming apparatus through the first intermediate connector unit 14-1 and the drawer connector 11. Consequently, temperature of the heater unit 1 is properly controlled by the controller in the main body of the image forming apparatus on the basis of the output signal of the thermistor 21.

When the thermal cutoff 31 is not in operation, the thermal cutoff 31 is in a conduction state between one end and the other end thereof, and temperature of the heater unit 1 is controlled by the controller in the main body of the image forming apparatus; but when the thermal cutoff 31 is in operation, the thermal cutoff 31 is in a cutoff state (in an insulation state) between one end and the other end thereof, and power supply to the heater unit 1 is stopped by the controller in the main body of the image forming apparatus.

(b) Status that both connections of the sensor unit 12 and the protection unit 13 are failed In this status, the wire 52 and the wire 54 are insulated from each other, and therefore, this status is similar to a status that the thermal cutoff 31 is in operation, and power supply to the heater unit 1 is stopped by the controller in the main body of the image forming apparatus.

(c) Status that the Connection of the Protection Unit 13 is Secured but the Connection of the Sensor Unit 12 is Failed In this status, even if the protection unit 13 is properly connected to the second intermediate connector unit 14-2, the loopback wire 23 of the sensor unit 12 is not electrically connected to the wire 52 or the intermediate wire 53. Therefore, in this status as well, the wire 52 and the wire 54 are also insulated from each other, and therefore, this status is similar to a status that the thermal cutoff 31 is in operation, and power supply to the heater unit 1 is stopped by the controller in the main body of the image forming apparatus.

As mentioned, the fuser device according to the aforementioned embodiment includes the heater unit 1; the sensor unit 12 that includes the thermistor 21 that detects a temperature at a predetermined position, and a connector 22; the protection unit 13 that includes the thermal cutoff 31 that cuts off a circuit in accordance with the temperature at the predetermined position, and a connector 32; the drawer connector 11 electrically connected to a main body of an image forming apparatus; the first intermediate connector unit 14-1 that electrically connects the connector 22 and the drawer connector 11 to each other; the second intermediate connector unit 14-2 that electrically connects the connector 32 and the drawer connector 11 to each other; and the intermediate wire 53 that electrically connects the first intermediate connector unit 14-1 and the second intermediate connector unit 14-2 to each other. Further, the connector 22 includes the loopback wire 23, the first intermediate connector unit 14-1 electrically connects an end of the loopback wire 23 to the drawer connector 11, the second intermediate connector unit 14-2 electrically connects an end of the thermal cutoff 31 to the drawer connector 11, and the intermediate wire 53 electrically connects an other end of the loopback wire 23 and an other end of the thermal cutoff 31 to each other.

Consequently, when connection failure of the sensor unit 12 occurs, regardless of a connection status of the protection unit 13, power supply to the heater unit 1 is continuously stopped, and therefore, while the sensor unit 12 and the protection unit 13 are independent of each other, malfunction of the fuser device is restrained.

Consequently, when connection failure of the sensor unit 12 occurs, regardless of a connection status of the protection unit 13, power supply to the heater unit 1 is continuously stopped, and therefore, while the sensor unit 12 and the protection unit are independent of each other, malfunction of the fuser device is restrained.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, the heater unit 1 may be a halogen heating element; and in such a case, the heater unit 1 may be electrically connected to the thermal cutoff 31 in series.

Further, in the aforementioned embodiment, the first intermediate connector unit 14-1 includes the connector 41 and the interconnection connector 42, but may include one connector instead of them. In the same manner, the second intermediate connector unit 14-2 includes the connector 43 and the interconnection connector 44, but may include one connector instead of them.

INDUSTRIAL APPLICABILITY

For example, the present invention is applicable to a fuser device built in an image forming apparatus.

The invention claimed is:

1. A fuser device, comprising:

a heater unit;

a sensor unit that comprises a sensor and a first connector, the sensor detecting a temperature at a predetermined position;

a protection unit that comprises a thermal cutoff and a second connector, the thermal cutoff cutting off a circuit in accordance with the temperature at the predetermined position;

an external connection connector electrically connected to a main body of an image forming apparatus;

a first intermediate connector unit that electrically connects the first connector and the external connection connector to each other;

a second intermediate connector unit that electrically connects the second connector and the external connection connector to each other; and an intermediate wire that electrically connects the first intermediate connector unit and the second intermediate connector unit to each other;

wherein the first connector comprises a loopback wire;

the first intermediate connector unit electrically connects an end of the loopback wire to the external connection connector;

the second intermediate connector unit electrically connects an end of the thermal cutoff to the external connection connector; and the intermediate wire electrically connects an other end of the loopback wire and an other end of the thermal cutoff.

2. The fuser device according to claim 1 wherein the first intermediate connector unit comprises a third connector electrically connected to the external connection connector, and a first interconnection connector that interconnects the third connector and the first connector; and the second intermediate connector unit comprises a fourth connector electrically connected to the external connection connector, and the first interconnection connector that interconnects the fourth connector and the second connector.

3. The fuser device according to claim 1 wherein the external connection connector is a drawer connector.

* * * * *